US006374799B1

(12) United States Patent
Firey

(10) Patent No.: US 6,374,799 B1
(45) Date of Patent: Apr. 23, 2002

(54) ENGINE BUBBLE JET IGNITER

(76) Inventor: Joseph Carl Firey, P.O. Box 15514, Seattle, WA (US) 98115-0514

( * ) Notice: Subject to any disclaimer, the term of this patent is extended or adjusted under 35 U.S.C. 154(b) by 0 days.

(21) Appl. No.: 09/757,672

(22) Filed: Jan. 11, 2001

(51) Int. Cl.[7] ..... F02P 21/00
(52) U.S. Cl. ..... 123/297; 123/143 B; 123/533; 123/144
(58) Field of Search ..... 123/297, 531, 123/533, 144, 143 B

(56) References Cited

U.S. PATENT DOCUMENTS 3,577,731 A * 5/1971 Bruchez, Jr. ..... 123/144
4,332,223 A * 6/1982 Dalton ..... 123/143 B
4,546,740 A * 10/1985 Clements et al. ..... 123/143 B
5,813,379 A * 9/1998 Firey ..... 123/143 B
5,899,195 A * 5/1999 Firey ..... 123/531
6,116,207 A * 9/2000 Firey ..... 123/250
6,260,546 B1 * 7/2001 Vaughn ..... 123/297

* cited by examiner

*Primary Examiner*—Erick Solis

(57) ABSTRACT

An igniter for internal combustion engines is described, wherein a fluid composition of liquid igniter fuel containing several air bubbles enrichened with fuel vapor, is created. This fluid composition is injected into the engine combustion chamber where the several bubbles are ignited. The consequent burning and expansion of the bubbles scatters burning fuel throughout the combustion chamber, thus creating many separate and distributed ignition points. Otherwise slow burning engine fuel air mixture can, in this way, be burned rapidly, completely, and efficiently.

11 Claims, 5 Drawing Sheets

ENGINE BUBBLE JET IGNITER

CROSS REFERENCES TO RELATED APPLICATIONS

This application is related to my issued U.S. Pat. No. 5,813,379, entitled, "Displacer Jet Igniter." This application is somewhat related to my following issued U.S. Patents:

U.S. Pat. No. 5,899,195; "Stratifier Apparatus for Engines"

U.S. Pat. No. 6,116,207; "Fuel Air Mixer and Proportioner"

BACKGROUND OF THE INVENTION

1. Field of the Invention

This invention is in the field of jet igniters for internal combustion engines of the piston and cylinder type, wherein a burning jet of fuel air mixture is used to ignite the principal air fuel mixture in each engine cylinder.

2. Description of the Prior Art

In those internal combustion engines of the piston and cylinder type which utilize fast burning principal air fuel mixtures, an ordinary electric spark, fired at the optimum time in the engine cycle, is adequate to accomplish the ignition needed to start the rapid burning of the principal air fuel mixture. When, however, a slow burning principal air fuel mixture is utilized, a jet igniter is frequently needed so that the burning can be completed in a reasonably short time interval. The jet igniter creates ignition sources of burning igniter gases distributed widely throughout the engine combustion chamber. As a result many burning zones are created and the total burn rate of the slow burning principal air fuel mixture becomes adequate to complete the burning thereof in a short time.

Examples of slow burning principal air fuel mixtures for engines are as follows:

1. Very lean gasoline in air mixture utilized to reduce exhaust emissions;
2. Very lean natural gas in air mixtures;
3. Producer gas in air mixtures utilized with some coal burning engines;

Prior art jet igniters have comprised the following elements:

1. A mixing chamber, separate from and smaller than the principal engine combustion chamber and connected thereto by a nozzle flow passage;
2. Means for introducing igniter fuel and air into the mixing chamber to create an igniter air fuel mixture therein;
3. Spark igniter means for igniting the igniter air fuel mixture in the mixing chamber;

Ignition and burning of the igniter air fuel mixture in the mixing chamber causes a pressure rise therein and this pressure increase forces the burning igniter air fuel mixture, through the nozzle flow passage, into the principal engine combustion chamber. This jet of burning igniter air fuel mixture then ignites the principal air fuel mixture at many places distributed throughout the engine combustion chamber. Prior art jet igniters have differed principally in the geometry of the mixing chamber and nozzle flow passage and in the means for introducing igniter fuel and air into the mixing chamber prior to ignition therein.

The igniter jet created by these prior art jet igniters is of short duration being limited by the burning time of the igniter fuel air mixture in the mixing chamber and the flow rate of the jet out through the nozzle. If longer jet duration is sought by use of a smaller diameter flow nozzle, nozzle maintenance problems result due to high velocities of flow of very hot burning gases.

A jet igniter apparatus, wherein the duration of jet flow could be adjusted as needed, and wherein the burning of the jet commenced beyond the jet nozzle, and inside the engine combustion chamber, would be a desirable improvement over these prior art jet igniters. Jet nozzle maintenance problems would be avoided, since the gases flowing therethrough would not yet be burning.

3. Definitions

The term piston internal combustion engine is used herein and in the claims to mean an internal combustion engine of the piston and cylinder type, or equivalent such as the Wankel engine type, and comprising:

At least one combined means for compressing and expanding gases, each combined means comprising an internal combustion engine mechanism comprising a variable volume chamber for compressing and expanding gases, and drive means for driving said internal combustion engine mechanism and varying the volume of said chamber through repeated cycles.

Each variable volume cycle comprises a compression time interval, when said variable volume is sealed and decreasing, followed by an expansion time interval, when said variable volume is sealed and increasing, these two time intervals together being a compression and expansion time interval.

Each combined means for compressing and expanding further comprises intake means for admitting reactant gases into said variable volume chamber prior to each compression time interval and exhaust means for removing reacted gases from said variable volume chamber after each expansion time interval.

Each variable volume cycle further comprises an exhaust time interval, when said variable volume is opened to said exhaust means, followed by an intake time interval, when said variable volume is opened to said intake means, these two time intervals being an exhaust and intake time interval; said exhaust and intake time interval following after a preceding expansion time interval and preceding a next following compression time interval. For a four stroke cycle piston internal combustion engine each separate time interval occupies approximately one half engine revolution and thus one stroke of the piston. For a two stroke cycle piston internal combustion engine the expansion time interval together with the exhaust time interval occupy approximately a half engine revolution and one piston stroke, and an intake time interval followed by a compression time interval occupy the next following half engine revolution and piston stroke.

A piston internal combustion engine further comprises a source of supply of reactant gas containing appreciable oxygen gas to each intake means, frequently air, or air containing fuel added thereto outside the variable volume chamber, and in an intake manifold. A piston internal combustion engine further comprises a source of principal engine fuel and means for delivering this fuel into the variable volume chamber.

Each cycle of the variable volume chamber further comprises a potential combustion time interval comprising that portion of the compression and expansion time interval during which principal engine fuel and reactant gas containing appreciable oxygen gas are both present within the variable volume chamber.

When this mixture of principal engine fuel and reactant gas containing appreciable oxygen gas, is ignited, a burning time interval occurs, preferably commencing late during the compression time interval, and ending early during the expansion time interval. Various types of igniters can be used to initiate burning of such fuel air mixtures such as spark igniters, glow plugs, or compression ignition.

SUMMARY OF THE INVENTION

Each bubble jet igniter of this invention comprises: an air displacer piston and cylinder enclosing an air displacer volume; an igniter fuel displacer piston and cylinder enclosing a fuel displacer volume; and these force air and igniter fuel together in an enclosed bubbleizer chamber, wherein a fluid composition is thusly created, comprising air bubbles within the liquid fuel. The air and fuel displacer pistons are each separately driven by larger area driver pistons, in driver cylinders, acted on by the pressure in the variable volume chamber. The fluid composition created in the bubbleizer chamber passes through an enclosed enrichener chamber, where evaporation of liquid fuel creates a stratified air fuel mixture within each bubble. From the enrichener chamber the fluid composition is forced through an igniter jet nozzle into the combustion chamber portion of the variable volume chamber. When within the engine combustion chamber, the stratified air fuel mixture within each bubble is ignited, as by compression ignition, or by an electric spark located near the igniter jet nozzle exit in the combustion chamber. The consequent burning of the bubble mixtures increases the pressure therein, and subsequent bubble expansion disperses burning fragments of liquid fuel throughout the engine combustion chamber. In this way many additional ignition regions are created, distributed throughout the engine combustion chamber. As a result, rapid combustion can be achieved, even when using slow burning principal fuel in air mixtures, and this is one of the principal beneficial objects of this invention.

Several valves, with actuators, and a valve controller are used, to turn on the bubble jet igniter at the desired start of the burning time interval, to turn off the bubble jet igniter, and to replenish the air and igniter fuel in the displacer volumes when the bubble jet igniter is turned off.

BRIEF DESCRIPTION OF THE DRAWINGS

An example valves timing sequence diagram is shown in FIG. 1 for the several valves shown in FIG. 2.

One form of bubble jet igniter of this invention is shown schematically in FIG. 2.

Figure 3:
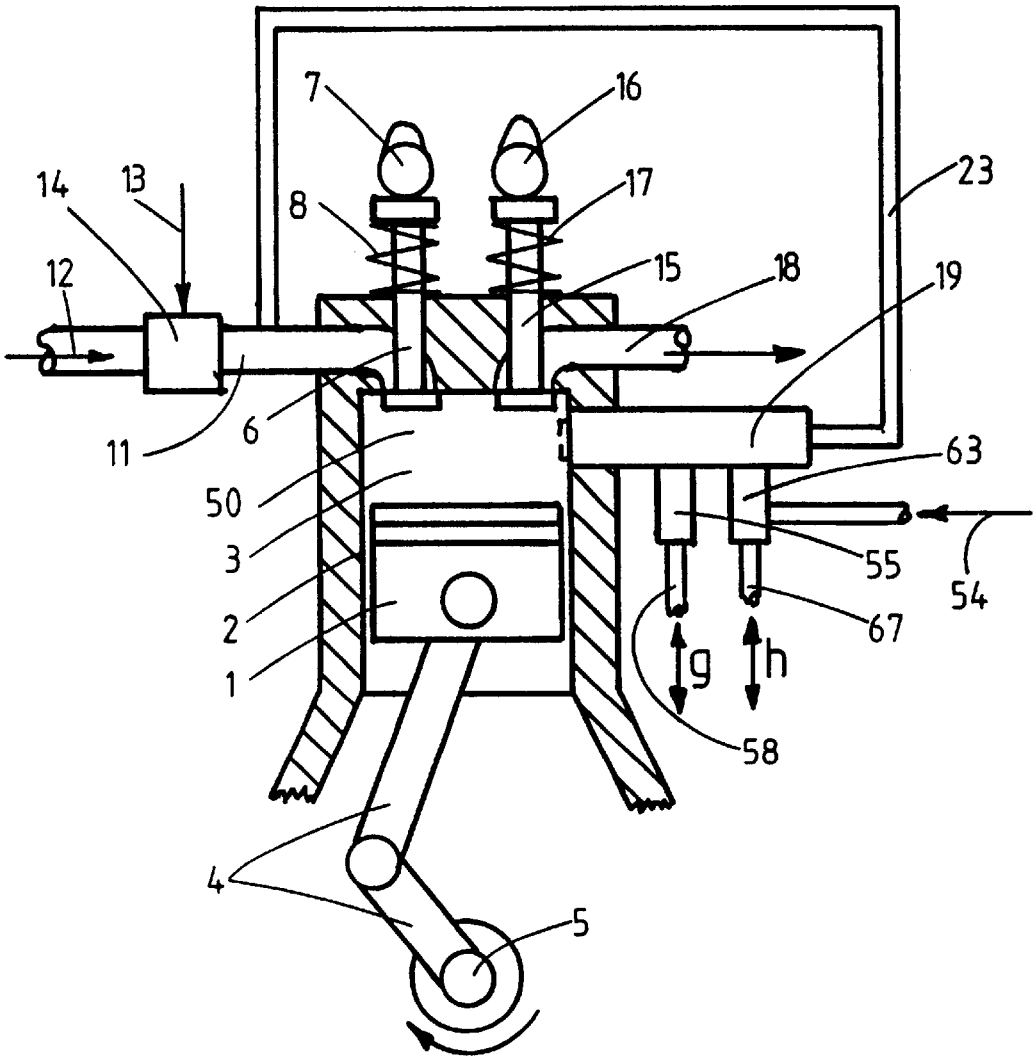
Figure 3:
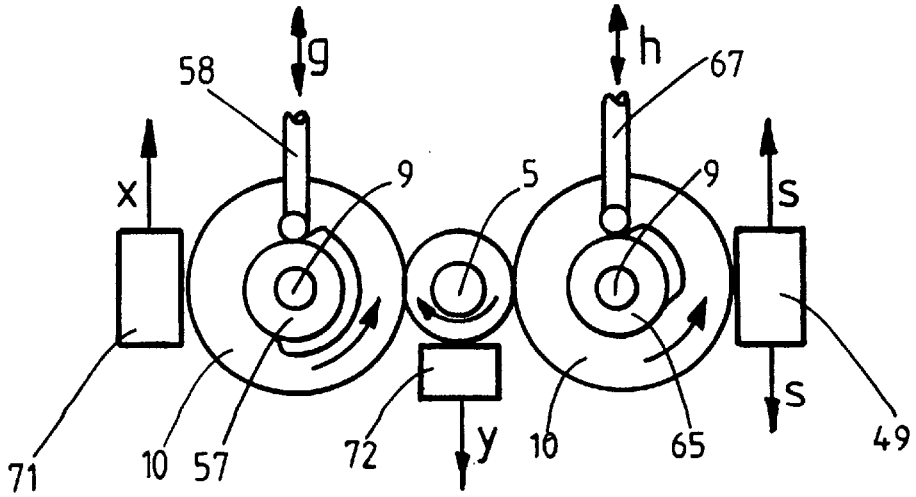

An installation of a bubble jet igniter on a four stroke cycle internal combustion engine is shown schematically in FIG. 3.

Figure 4:
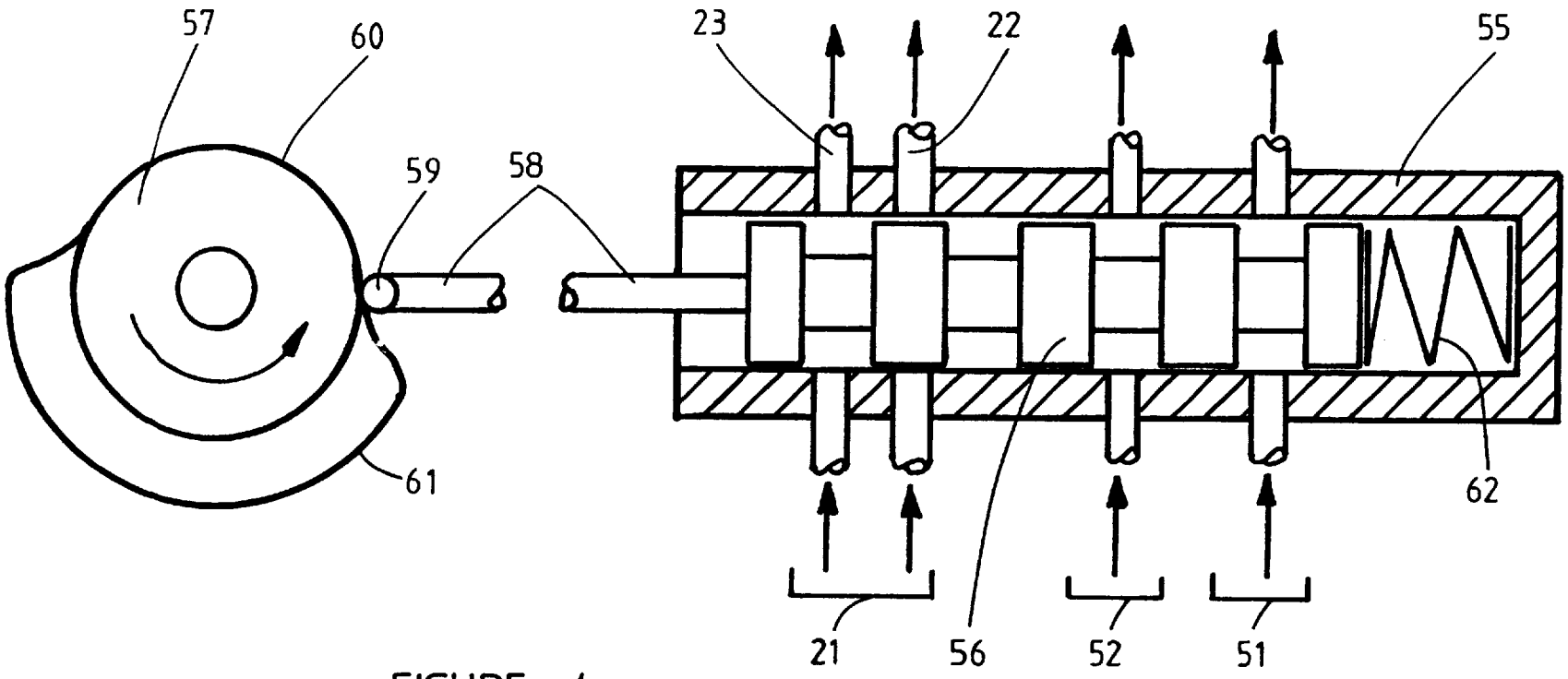
Figure 5:
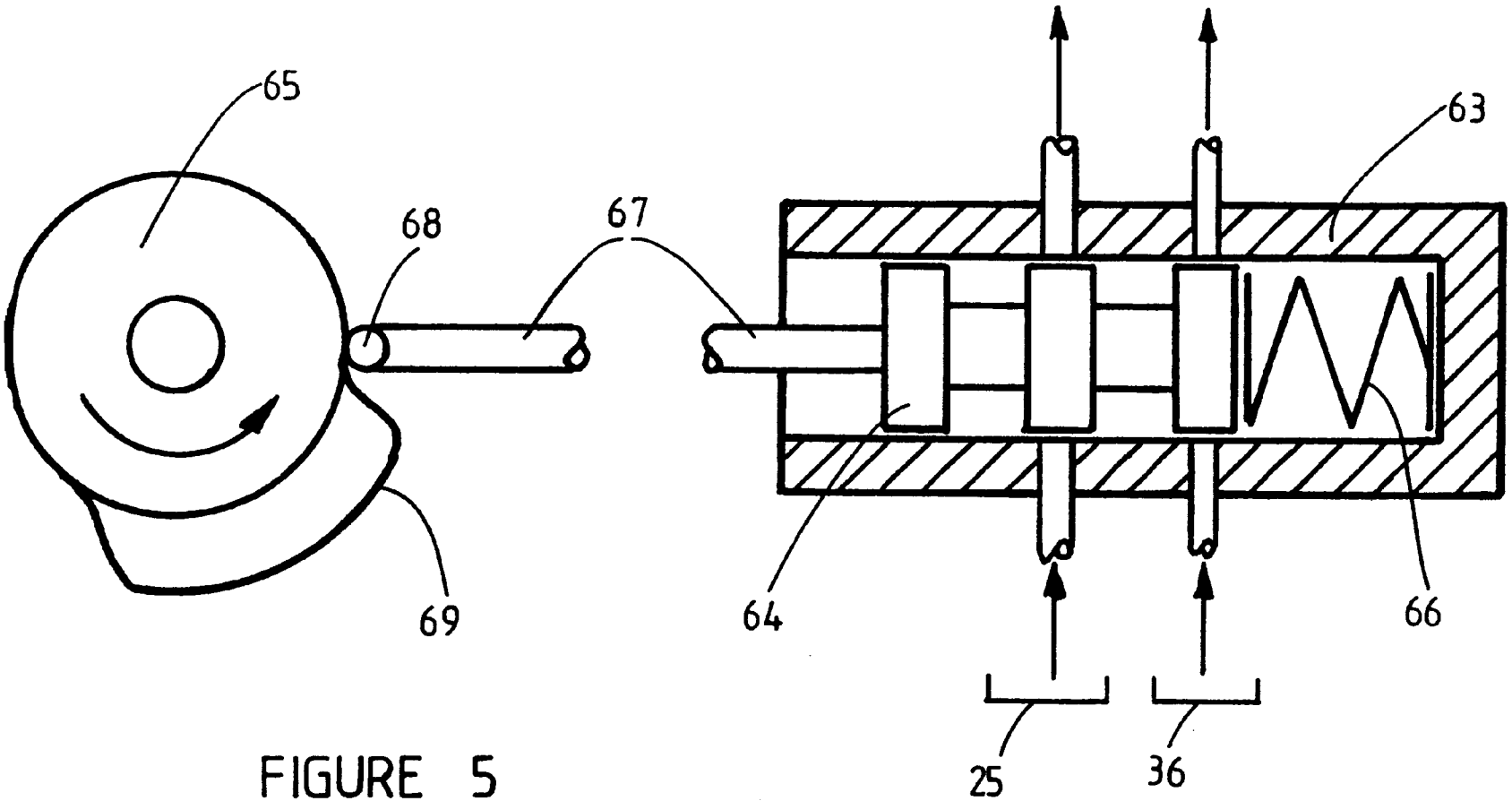

A mechanical valves controller and actuator scheme is shown schematically in FIG. 4 and FIG. 5.

DESCRIPTION OF THE PREFERRED EMBODIMENTS

A. General Description

The bubble jet igniters of this invention are for use as a means for igniting the principal fuel and air mixture in the variable volume chamber of a piston type internal combustion engine, as described hereinabove, at the preferred time in the engine cycle. Each cylinder of an engine is fitted with at least one bubble jet igniter and each bubble jet igniter comprises the following elements:

1. An air displacer piston operates within a cylinder and these enclose an air displacer volume. An air driver piston operates within a cylinder and these enclose an air driver volume. The air displacer side opposite the air displacer volume is mechanically connected to the air driver piston side opposite the air driver volume and the volume enclosed between these pistons is vented to a vent pressure, such as the atmosphere. The area of the air driver piston is larger than the area of the air displacer piston so that the pressure in the displacer volume can be greater than the pressure in the driver volume.
2. This assembly of the air displacer piston and cylinder together with the air driver piston and cylinder as described hereinabove is herein referred to as an air displacer means for compressing and displacing air.
3. A fuel displacer piston operates within a cylinder and these enclose a fuel displacer volume. A fuel driver piston operates within a cylinder and these enclose a fuel driver volume. The fuel displacer piston side opposite the displacer volume is mechanically connected to the fuel driver piston side opposite the driver volume and the volume enclosed between these pistons is vented to a vent pressure, such as the atmosphere. The area of the fuel driver piston is larger than the area of the fuel displacer piston so that the pressure in the displacer volume can be greater than the pressure in the driver volume.
4. This assembly of the fuel displacer piston and cylinder together with the fuel driver piston and cylinder as described hereinabove is herein referred to as fuel displacer means for compressing and displacing fuel.
5. The ratio of fuel driver piston area to fuel displacer piston area is equal to the ratio of air driver piston area to air displacer piston area. Thus, when the same variable volume chamber pressure is applied to both driver pistons, both displacer volumes will be compressed to the same pressure, which will be greater than the variable volume pressure.
6. A two way driver valve, with actuator, can connect both the air driver volume and the fuel driver volume, concurrently to the pressure in the variable volume chamber, when the air in the air displacer volume and the fuel in the fuel displacer volume are to be compressed. This two-way driver valve can alternatively connect both the air driver volume and the fuel driver volume to a low pressure vent, such as the engine intake manifold, when the air displacer piston and the fuel displacer piston are to be retracted for refilling of the air displacer volume with air and of the fuel displacer volume with fuel.
7. An enclosed bubbleizer chamber is connected, via an on-off fuel delivery valve, with actuator, to the fuel displacer volume, and is also separately connected, via an on-off air delivery valve, with actuator, to the air displacer volume.
8. When the air and fuel, in their respective displacer volumes, are compressed by application of variable volume chamber pressure to both driver volumes, opening of the fuel delivery valve and the air delivery valve, causes air and liquid fuel to flow into the bubbleizer chamber, and therein create a fluid composition of air bubbles within the liquid fuel. Compression of the air within the air displacer volume occurs by appreciable motion of the air displacer piston, when driven by the air driver piston, acted on by variable volume chamber pressure. This air displacer piston motion will create pressure waves, reverberating within the air displacer volume. Opening of the air delivery valve will cause rarefaction wave reverberation within the air displacer volume. As a result of these pressure and, rarefaction waves, the flow of air into the bubbleizer chamber will occur in several separate pulses, thus creating several separate air bubbles within the liquid fuel.

9. From the bubbleizer chamber, the fluid composition passes into the enclosed enrichener chamber, where portions of the liquid fuel evaporate into the air bubbles. A stratified air fuel vapor mixture is thusly created within each bubble, this mixture being fuel richer adjacent to the bubble-liquid interface, and fuel leaner at the bubble center.

10. The fluid composition flows out of the enrichener chamber into the combustion chamber end of the variable volume chamber, via the igniter jet nozzle during delivery.

11. The air fuel vapor mixture, within each bubble of the fluid composition, can be spark ignited when within the engine combustion chamber, by placing the electrodes of an electric spark igniter at the exit of the igniter jet nozzle. Alternatively, the air fuel vapor mixture within each bubble can be compression ignited after expiration of the compression ignition time delay period, when the fluid composition is within the engine combustion chamber. An adequate engine compression ratio will be needed for this compression ignition method.

12. Since the air fuel vapor mixture within each bubble is stratified, portions thereof will lie within the spark ignitability limits of the fuel, and other, and larger, portions thereof will lie within the compression ignitability limits of the fuel. Hence ignition of each bubble can be assured when within the engine combustion chamber.

13. Burning of the air fuel vapor mixture within each bubble greatly increases the pressure therein. The consequent expansion of the bubbles scatters burning fuel fragments throughout the engine combustion chamber. Each such burning fuel fragments acts as an ignition source for adjacent principal engine fuel in air mixtures. As a result, a large number of separate burning flame zones are created, each with a rather short flame path length to completion of burning. Completion of burning of the principal engine fuel in air mixture is, in this way, accomplished in a short time interval, even when these are slow burning mixtures, and this is one of the principal beneficial objects of this invention.

14. After injection of the fluid composition into the engine combustion chamber and the ignition and burning therein, the air displacer volume is to be resupplied with air, and the fuel displacer volume is to be resupplied with igniter fuel at pressure from an igniter fuel source, for the next engine cycle. For this resupply purpose, the fuel delivery valve and the air delivery valve are both closed and the two-way driver valve is connected to vent. The air displacer volume is then connected via the air supply on-off valve with actuator, to the variable volume chamber, during the next following compression time interval. Compression in the variable volume chamber forces air into the air displacer volume and the air displacer piston is retracted, the air driver volume being vented. The fuel displacer volume is connected via the fuel supply on-off valve with actuator, to the igniter fuel source. The igniter fuel is at a sufficient pressure from the source to force fuel into the fuel displacer volume, and the fuel displacer piston is retracted, the fuel driver volume being vented.

15. The air quantity resupplied to the air displacer volume can be set by a stop bar, as in the driver volume, which limits the extent of displacer piston retraction. The fuel quantity resupplied to the fuel displacer volume can be similarly set by use of a displacer piston retraction stop bar. Alternatively, a metered fuel quantity can be supplied from the source.

16. After resupply is completed, the air supply valve and the fuel supply valve are closed prior to opening of the air delivery valve and the fuel delivery valve.

17. The burning time interval, which commences when the bubbles in the injected fluid composition are ignited, is to be timed to commence late during the compression time interval and the opening of the air and fuel delivery valves, and the setting of the driver valve to variable volume pressure, are to be timed accordingly. A controller is needed for this timing purpose, responsive to a sensor of engine crank angle and variable volume cycle timing, and operative upon the several valves of the bubble jet igniter, so that the following sequence of valve settings is achieved. This sequence is for a four stroke cycle internal combustion engine, and starts at the beginning of the intake time interval, with the engine piston at top dead center.

a. The two way driver valve is open to vent during at least a portion of the exhaust and intake time interval and on into a portion of the compression time interval;

b. The fuel supply valve is open during a portion of the exhaust and intake time interval when the two way driver valve is open to vent;

c. The air supply valve is open during at least that same portion of the compression time interval when the two-way driver valve is open to vent.

d. With the above connections, fuel is resupplied into the fuel displacer volume, and air is resupplied into the air displacer volume prior to the later portions of the compression time interval.

e. At the start of the burning time interval, during the later portion of the compression time interval, the fuel and air supply valves are closed, the two way driver valve is opened to the variable volume chamber, and the fuel and air delivery valves are opened.

f. The compression pressure, thusly applied to the driver pistons, causes air and fuel to flow into the bubbleizer chamber, to create the fluid composition, whose bubbles are then fuel enrichened in the enrichener chamber, and the fluid composition is injected into the combustion chamber end of the variable volume chamber, where it is ignited to initiate the burning time interval;

g. To avoid hot gas backflow into the enrichener chamber and bubbleizer chamber, the two way driver valve remains open to the variable volume chamber throughout the expansion time interval. The fuel and air supply valves are not opened until the two way driver valve is opened to vent.

h. The fuel delivery valve is open, commencing at the start of the burning time interval, and thereafter during at least a portion of the time when the two way driver valve is open to the variable volume chamber, and is dosed at other times of each variable volume cycle;

i. The air delivery valve is open during at least a portion of the time when the two way driver valve is open to the variable volume chamber, and is closed at other times of each variable cycle;

j. An example valve sequence is illustrated diagrammatically in FIG. 1 for a 4 stroke cycle internal combustion engine;

k. When an electric spark is used to ignite the bubbles in the fluid composition the controller additionally times the energizing of the spark igniter to occur whenever the fuel delivery valve is open;

l. Several types of controllers can be used for the purposes of this invention, such as mechanical controllers or electronic controller, and examples of such controllers are described hereinafter;

B. An example bubble jet igniter of this invention, using a mechanical controller of the valves, is shown schematically in FIG. 3, on a four stroke cycle internal combustion engine. Additional details of this mechanically controlled bubble jet igniter are shown schematically in FIG. 2, FIG. 4, and FIG. 5, and the valve sequence diagram of FIG. 1.

1. The four stroke cycle internal combustion engine shown in FIG. 3 comprises:

a. A combined means for compressing and expanding gases includes an internal combustion engine mechanism with a piston, 1, operative within a cylinder, 2, and these enclosing a variable volume chamber, 3, whose volume is varied by action of the drive means, 4, for driving the internal combustion engine mechanism. A crankshaft, 5, and connecting rod example drive means is shown in FIG. 3. This combined means for compressing and expanding further comprises an intake means for admitting reactant gases into the variable volume chamber, 3, and comprising: an intake valve, 6; an intake valve drive cam, 7, and return spring, 8; an intake valve cam drive means, 9, for driving the intake valve cam, 7, from the engine crankshaft, 5, via a two to one reduction gear, 10; an intake manifold, 11, with air inlet, 12, fuel supply source, 13, and fuel-air mixing device, 14. This combined means for compressing and expanding further comprises an exhaust means for removing reacted gases from the variable volume chamber, 3, and comprising: an exhaust valve, 15; an exhaust valve drive cam, 16, and return spring, 17; an exhaust valve cam drive means, 9, for driving the exhaust valve cam, 16, from the engine crankshaft, 5, via the two to one reduction gear, 10; an exhaust manifold, 18. The four stroke cycle comprises the following steps:

(i) A compression time interval occurs when both valves, 6, 15, are closed and the piston, 1, is rising and decreasing the variable volume, 3, thus compressing gases contained therein.

(ii) An expansion time interval follows next after the compression time interval and both valves, 6, 15, remain closed while the piston, 1, is descending and increasing the variable volume, 3, thus expanding gases contained therein.

(iii) Compression followed by expansion occupy essentially one full revolution of the engine crankshaft, 5, and this is a compression and expansion time interval for this four stroke cycle engine.

(iv) An exhaust time interval follows next after the expansion time interval, and the intake valve, 6, remains closed, and the exhaust valve, 15, is opened while the piston, 1, is rising and decreasing the variable volume, 3, thus forcing gases out of the variable volume and into the exhaust manifold, 18.

(v) An intake time interval follows next after the exhaust time interval, and the intake valve, 6, is opened, and the exhaust valve, 15, is closed while the piston, 1, is descending and increasing the variable volume, 3, thus drawing a fuel-air mixture as reactant gases containing appreciable oxygen gas from the intake manifold, 11.

(vi) Exhaust followed by intake occupy essentially another full revolution of the engine crankshaft, 5, and this is an exhaust and intake time interval.

(vii) Combustion of the fuel-air mixture can occur within the variable volume chamber, 3, whenever such a mixture is present therein during the compression and expansion time interval, and this period is herein referred to as the potential combustion time interval.

(viii) Actual burning of the fuel-air mixture, within the variable volume chamber, during the potential combustion time interval, commences when an igniter ignites the fuel-air mixture, and ends when the fuel air mixture is essentially completely burned, thus ending the potential combustion time interval. For a gasoline engine and a natural gas engine this burning time interval preferably commences during the latter part of the compression time interval and ends during the early part of the expansion time interval.

(ix) This actual burning of the fuel air mixture, during the burning time interval, is initiated by a displacer jet igniter, 19, of this invention such as described hereinbelow.

Figure 1:
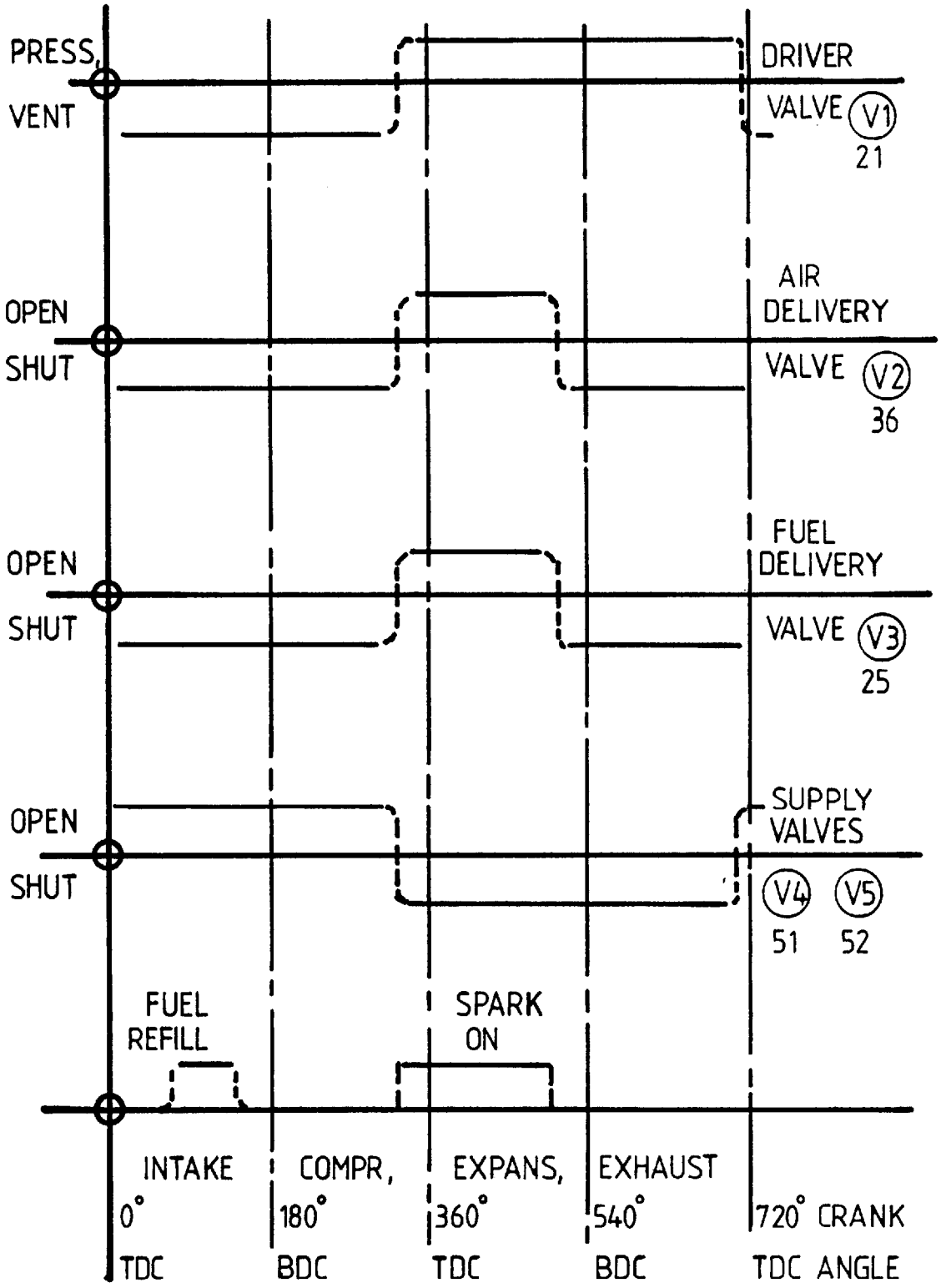

2. The bubble jet igniter shown schematically in FIG. 2 comprises the following elements:

a. The air displacer piston, 26, operates within the cylinder, 27, and these enclose the air displacer volume, 28. The air driver piston, 29, operates within the cylinder, 30, and these enclose the air driver volume, 31. The air displacer piston side, 32, opposite the air displacer volume, 28, is connected to the driver piston side, 33, opposite the air driver volume, 31, and the vented volume, 34, is vented to atmosphere via the vent, 35, in this FIG. 1 and FIG. 2 example. The area of the air driver piston, 29, is larger than the area of the air displacer piston, 26.

b. The pressure in the air displacer volume, 28, is greater than the pressure in the air driver volume, 31, since the driver piston area is greater than the displacer piston area.

c. The igniter fuel displacer means for compressing and displacing igniter fuel is similar in apparatus and function to the above described air displacer means for compressing and displacing air and comprises the following elements:

(i) An igniter fuel displacer piston, 41;

(ii) An igniter fuel displacer cylinder, 42;

(iii) An igniter fuel displacer volume, 43;

(iv) An igniter fuel driver piston, 44;

(v) An igniter fuel driver cylinder, 45;

(vi) An igniter fuel driver volume, 46;

(vii) A vented volume, 47, and vent, 48;

d. The ratio of fuel driver piston, 44, area to fuel displacer piston, 41, area is equal to the ratio of air driver piston, 29, area to air displacer piston, 26, area. The air driver volume, 31, and the fuel driver volume are connected together via open connection, 20, so the pressure is equal in both driver volumes, 31, 46. Hence the pressure will also be equal in both displacer volumes, 28, 43.

e. The two way driver valve, 21, connects both the air driver volume, 31, and the fuel driver volume, 46, either to the engine variable volume chamber, 3, via connection, 22, or to a vent, such as the engine intake manifold, 11, via connection, 23. Concurrent compression of the air in the air displacer volume, 28, and the fuel in the fuel displacer volume, 43, occurs when the two way valve, 21, is open to the variable volume chamber, 3, during the compression time interval. Both the driver volumes, 31, 46, are vented, via the two way valve, 21, when on connection, 21, when the displacer pistons, 26, 41, are to be retracted for resupplying the air and fuel displacer volumes.

f. During compression, liquid fuel flows into the bubbleizer chamber, 24, when the fuel delivery valve, 25, is opened, and air also flows into the bubbleizer chamber, 24, when the air delivery valve, 36, is opened. A fluid composition of liquid fuel and air bubbles is thusly created in the bubbleizer chamber, 24.

g. The fluid composition of liquid fuel containing air bubbles flows from the bubbleizer chamber, 24, into the enrichener chamber, 37, where portions of the fuel evaporate into the air bubbles and create a stratified air fuel mixture within each bubble.

h. The fluid composition leaves the enrichener chamber, 37, through the igniter jet nozzle, 38, and enters the variable volume chamber, 3, where each bubble can be ignited by energizing the spark electrodes, 39, 40, from the spark generator, 49. Alternatively, each bubble can be ignited by compression ignition, when inside the variable volume chamber, 3, after expiration of the compression ignition time delay period.

i. The pressure rise of bubble burning scatters burning liquid fuel fragments throughout the combustion chamber end, 50, of the variable volume chamber, 3, thus initiating many separate burning zones in the principal engine air fuel mixture. In this way rapid and complete burning of the principal air fuel mixture is achieved.

j. The air displacer volume, 28, can be resupplied with air during the first portions of the following compression time interval, by closing the air delivery valve, 36, venting the driver valve, 21, and opening the air supply valve, 51, the compression pressure in the variable volume chamber, 3, acting to retract the air displacer piston, 26.

k. The fuel displacer volume, 43, can be resupplied with fuel, during the time when the driver valve, 21, is vented, by closing the fuel delivery valve, 25, and opening the fuel supply valve, 52. Fuel, from the igniter fuel source, 53, can be delivered by the fuel pump, 54, at a pressure sufficient to retract the fuel displacer piston, 41. The fuel quantity thus resupplied for the next engine cycle can be set by various methods, as for example, use of a fixed displacement pump, 54, driven at camshaft speed, to cause one fuel pump stroke per engine cycle, at some time during the intake time interval, as shown on the FIG. 1 valve sequence timing diagram.

l. Resupply valves, 51 and 52, are closed prior to connecting the two way valve, 21, to the variable volume chamber, 3, via connection, 22.

m. An example, wholly mechanical, controller, and actuator of the several valves of the FIG. 2 form of the invention, and sensor of engine crank angle and variable volume cycle timing, is shown schematically in FIG. 3, FIG. 4 and FIG. 5, suitable for carrying out the sequence of valve settings shown in FIG. 1, and comprises the following elements:

(i) The two way driver valve, 21, the on-off fuel supply valve, 52, the on-off air supply valve, 51, are combined into a single first spool valve, 55, as shown in FIG. 4. The valve spool, 56, is actuated by the first control and timing cam, 57, with return spring, 62, via the push rod, 58. As shown on FIG. 3, the first control and timing cam, 57, is driven, at half crankshaft speed, via the camshaft drive gear, 10, from the engine crankshaft, 5, and thus functions, not only as a valve actuator and controller, but also as a sensor of crank angle and variable volume cycle timing. As shown in FIG. 4 and FIG. 3, the cam follower, 59, is on the cam base circle, 60, with the two-way drive valve, 21, connected to vent, 23, the air supply valve, 51, and the fuel supply valve, 52, open. The cam follower, 59, is about to rise on to the raised cam portion, 61, when the two way driver valve, 21, will be connected to the variable volume chamber, 3, via connection, 22, the air supply valve, 51, and the fuel supply valve, 52, will be closed. Thus as shown in FIG. 3, FIG. 4 and FIG. 1, the compression time interval is taking place at a crank angle between about 270 and 360 degrees, and resupply of the fuel displacer volume, and the air displacer volume, has been completed; near the end of this compression time interval;

(ii) The on-off fuel delivery valve, 25, and the on-off air delivery valve, 36, are combined into a single second spool valve, 63, as shown in FIG. 5. The valve spool, 64, is actuated by the second control and timing cam, 65, with return spring, 66, via the push rod, 67. As shown on FIG. 3, this second control and timing cam, 65, is driven from the crankshaft, 5, via the camshaft drive gear, 10, as described hereinabove for the first control and timing cam, 57, and thus also functions in the same manner as a combined actuator, controller and sensor. As shown in FIG. 5 and FIG. 3, the delivery valves, 25, 36, are both closed and the compression time interval is approaching an end. The delivery valves, 25, 36, will shortly be opened when the cam follower, 68, is on the raised portion, 69, of the cam, 65, and fuel and air delivery into the bubbleizer chamber, 24, will then commence, with the two way valve, 21, connected to the variable volume chamber, 3. This bubble jet igniter will then inject a fluid composition into the combustion chamber end, 50, of the variable volume chamber, 3, to initiate the burning time interval therein;

(iii) After all fuel has been displaced out of the fuel displacer volume, 43, the fuel delivery valve, 25, and the air delivery valve, 36, can be closed at some time later during the expansion time interval, as shown on FIG. 1;

(iv) At some time after the expansion time interval, the two way driver valve, 21, can be vented, and the supply valves, 51, 52, can be opened as also shown on FIG. 1, so that refilling of the fuel displacer volume, 43, and the air displacer volume, 28, can follow thereafter;

3. This example mechanical bubble jet igniter is shown in FIG. 3 and FIG. 1, on a four stroke cycle internal combustion engine. But entirely similar mechanical bubble jet igniters of this invention can be used on two stroke cycle internal combustion engines, wherein each variable volume cycle is completed within one crank revolution and 360 degrees of crank angle. The cams, 57, 65, would then be rotated at crankshaft speed instead of at half crankshaft speed.

C. Electronic Controller

The several valves of the FIG. 2 form of bubble jet igniter can be solenoid actuated, and electronically controlled, as an alternative to the mechanical actuation and control described hereinabove. Such solenoid valve actuators can be direct acting or can function as pilot valves for pneumatic or hydraulic drive, as is well known in the art of valve actuators. An example electronic control scheme for the FIG. 2 form of bubble jet igniter is shown schematically on FIG. 2 and FIG. 3, for a four stroke cycle internal combustion engine, and comprises the following elements:

1. The electronic controller, 70, receives an input, x, from a sensor, 71, of engine crank angle and variable volume cycle timing;
2. The controller, 70, is operative upon the two way driver valve, 21, actuator via output, a;
3. The controller, 70, is operative upon the air delivery valve, 36, actuator via output, b; and is operative upon the fuel delivery valve, 25, actuator via output, c;
4. The controller, 70, is operative upon the air supply valve, 51, actuator via output, d; and is operative upon the fuel supply valve, 52, actuator via out put, e;
5. The valves sequence, shown in FIG. 1, can be programmed into the electronic controller, 70, to operate the bubble jet igniter of FIG. 2 in the same way, as described hereinabove for the mechanical controller and actuator;
6. Alternatively the valves sequence can be changed in response to changes in engine operating conditions. For example, the controller, 70, could receive an additional input, y, from an engine crankshaft speed sensor, 72, and control the delivery values, 25, 36, to open earlier during the compression time interval, as engine speed increased. Such earlier initiation of the engine burning time interval, at higher engine speed, may be preferred in engines using slow burning principal air fuel mixtures.
7. The electronic controller, 70, could also be programmed to delay closing of the air delivery valve, 36, to later than the closing of the fuel delivery value, 25, so that the fuel inside the bubbleizer chamber, 24, and the enrichener chamber, 37, can be fully air blown into the engine combustion chamber, 50. Fuel leakage losses, from these chambers, during the exhaust time interval, can thusly be avoided.
8. The electronic controller, 70, could also be programmed to delay opening of the air delivery valve, 36, to later than the opening of the fuel delivery valve, 25, so that liquid fuel is already present within the bubbleizer chamber to receive the air as bubbles.
9. The electronic controller, 70, could additionally be programmed to periodically interrupt the delivery of air into the bubbleizer chamber, 24, while fuel is being delivered thereinto, in order to create several discrete air bubbles, within each liquid fuel quantity being delivered for each engine cycle. As engine speed is increased, the time duration of injection of the fluid composition, into the combustion chamber, should be decreased, in order that injection be carried out during essentially the same duration of crank angle. The electronic controller, 70, can achieve this result, using this pulsed air delivery into the bubbleizer, by shortening the net duration of air flow per cycle into the bubbleizer, with fewer air pulses, or pulses of shorter duration, or both, as engine speed is increased. With less air in the fluid composition, it will be of smaller total volume and thus will flow more quickly through the igniter jet nozzle, 38, as engine speed is increased.
10. An electronic controller, 70, is usually preferred for carrying out several kinds of changes of the valves sequence of the bubble jet igniter. In principle, these same changes could, alternatively, be carried out using mechanical controllers, but increased complexity usually results, particularly in applying external sensor inputs to the operation of the mechanical controller.

D. Igniter Fuels

1. Various kinds of igniter fuels can be used with the bubble jet igniters of this invention, such as diesel fuel, gasoline, jet fuel, etc. Special, more easily compression ignitable fuels, such as ethyl ether, can be used alone or blended, to improve low temperature startup of an engine. In principle, gaseous igniter fuels, such as propane, butane or natural gas could also be used. But these gaseous fuels will be more difficult to scatter throughout the combustion chamber during ignition, due to their low density and hence large volume. For this reason liquid igniter fuels will usually be preferred.
2. The igniter fuel quantity per engine cycle can be set in various ways. For example, a stop bar, 73, can limit the retraction of the displacer piston, 41, during refilling, and thus fix the fuel volume refilled into the displacer volume, 43. Alternatively the fuel transfer pump, 54, can transfer fuel from the source, 53, into the displacer volume, 43, at a constant flow rate per engine crank angle. The fuel quantity thus transferred, per engine cycle, can then be controlled by controlling the crank angle duration of opening of the fuel supply valve, 52.
3. In some engine applications, the igniter fuel quantity may also be the principal engine fuel quantity, or a large portion thereof. In these applications the igniter fuel quantity per engine cycle will need to be adjustable in proportion to engine torque. For example, with a torque input, z, to the controller, 70, the duration of opening of the fuel supply valve, 52, could be proportioned to engine torque required. Alternatively the fuel transfer pump, 54, could be of the Bosch type which delivers an adjustable fuel quantity per pump stroke.

E. Beneficial Objects

In common with prior art jet igniters, the bubble jet igniters of this invention can initiate burning of the principal engine air fuel mixture at many separate places dispersed throughout the engine combustion chamber. In this way rapid and complete burning of the principal air fuel mixture is obtained, even when slow burning mixtures such as very fuel lean mixtures, are being used.

For bubble jet igniters of this invention, burning takes place only within the engine combustion chamber, and not within any portion of the igniter itself. Thus special high temperature capable materials or special cooling provisions are unnecessary, and this is an advantage of this bubble jet igniter over those prior art jet igniters which use a separate mixing chamber, within which burning is initiated.

One advantage of the bubble jet igniter of this invention, over the displacer jet igniter of my earlier, cross referenced, U.S. Pat. No. 5,813,379, is that herein igniter air is supplied from the engine variable volume chamber, instead of from an external source of compressed air, resulting in a simplified apparatus. Compression ignition of the bubbles can be used with a bubble jet igniter, and the resulting very abrupt pressure rise, within each bubble, will act to very powerfully, and widely, scatter the burning fuel fragments throughout the engine combustion chamber. Improved initiation of the burning of the principal air fuel mixture can thus be obtained, as compared to the oil burner type, spark ignition, of a fuel air spray, utilized in my earlier displacer jet igniter of U.S. Pat. No. 5,813,379. A bubble jet igniter of this invention can compensate igniter jet duration, for changes of engine speed, by adjusting the volume ratio of air to fuel, which is a simpler compensation method than the adjustable orifice areas method, used in the displacer jet igniters of U.S. Pat. No. 5,813,379.

F.Sizing

For purposes of sizing a bubble jet igniter of this invention, an igniter fuel mass ratio (FMR) is defined as follows:

$$(FMR) = \frac{\text{Igniter fuel mass per cycle}}{\text{Principal engine fuel mass per cycle}}$$

Higher values of (FMR) yield more rapid ignition and burnup of the principal fuel air mixture but require use of larger quantities of igniter fuel which may be expensive.

Also for purposes of sizing a bubble jet igniter, a bubble volume ratio (BVR) is defined as follows:

$$(BVR) = \frac{\text{Bubble volume in fluid composition}}{\text{Fuel volume in fluid composition}}$$

Higher values of (BVR) increase the fragmentation and scattering of burning fuel particles during ignition in the engine combustion chamber and thus yield more complete burnup of the principal fuel air mixture. However an unnecessarily high value of (BVR) increases the work loss of igniter air transfer from the variable volume chamber into the bubbleizer chamber.

Figure 2:
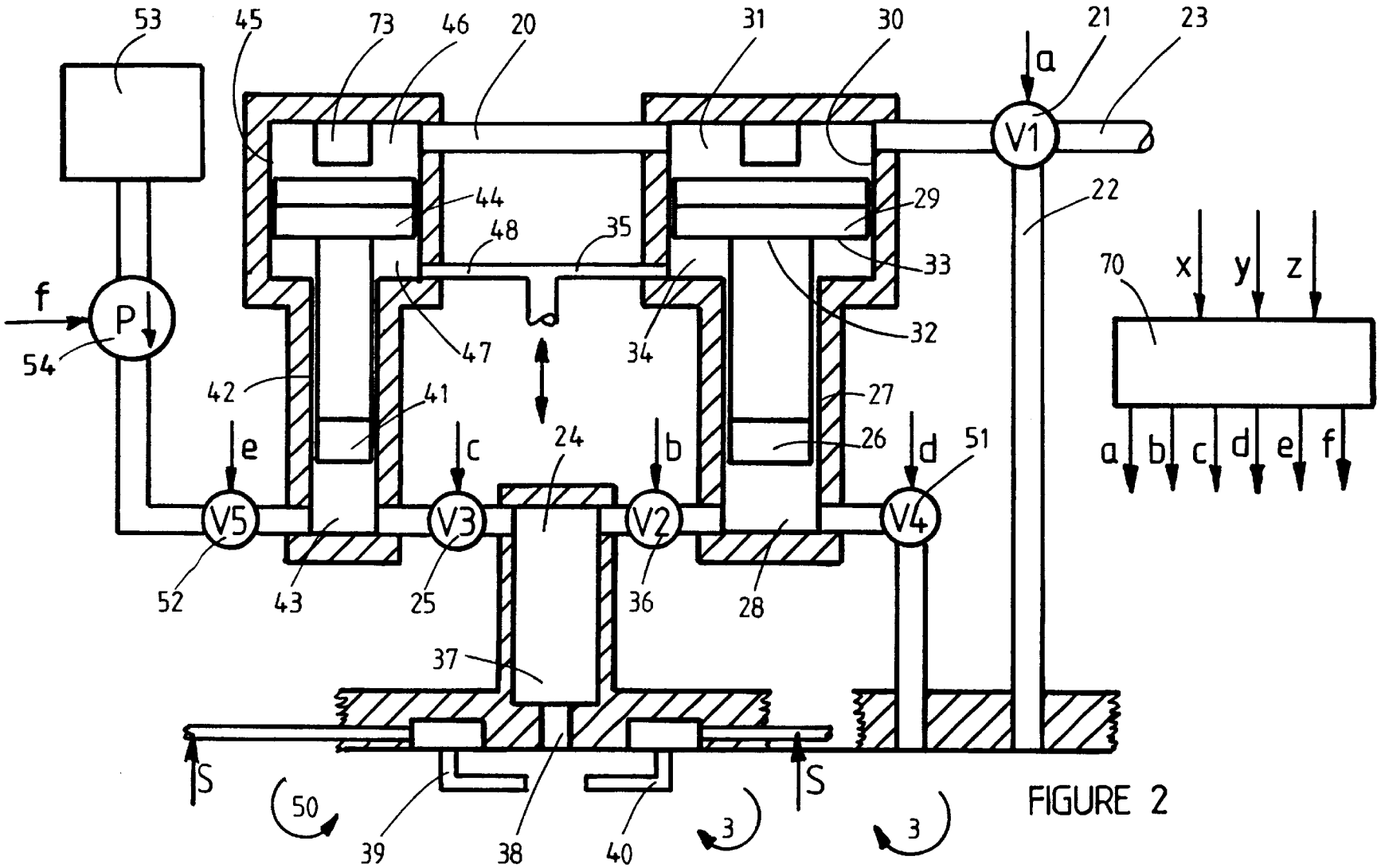

Best values of (FMR) and (BVR) are preferably determined experimentally in a running engine. Estimated values can be used for preliminary design purposes in the following approximate relations:

(LV)=Fuel displacer volume, 43, on FIG. 2;

$$(LV) = \frac{(FMR)}{(DF)}(EA)(FAS)(EQ)$$

(BV)=Air displacer volume, 28, on FIG. 2;

(BV)=(LV)(BVR)

Wherein:

(EA)=Engine air mass per cycle;

(EA)=(VD)(DA)(EV)

(VD)=Engine displacement volume per cylinder;

(DA)=Engine intake air density;

(EV)=Engine volumetric efficiency;

(FAS)=Stoichiometric mass ratio of principal engine fuel to engine air;

(DF)=Igniter fuel density;

(EQ)=Engine operating equivalence ratio;

Any consistent system of units can be used in the above approximate relations.

The flow area of the igniter jet nozzle, 38, on FIG. 2, can be roughly estimated by the following relations:

(AJ)=Jet nozzle area, in square feet;

$$(AJ) = \frac{(WI)}{(DF)}\frac{2(\text{pi})(RPM)}{(CAJ)(60)(CJ)}[(S)+(H)]$$

Wherein:

(WI)=Igniter fuel mass, pounds;

(WI)=(LV) (DF)

(RPM)=Engine crankshaft speed, revolutions per minute;

(CAJ)=Crank angle duration of injection of fluid composition into the engine combustion chamber, radians;

(CJ)=Orifice coefficient of the igniter jet nozzle;

(DF)=Igniter fuel density pounds mass per cubic foot;

$$(S) = \frac{(BVR)}{(28.2)(\sqrt{(TP)})}$$

(TP)=Absolute displacer air temperature, degrees Rankine, and can be roughly approximated as somewhat higher than engine cooling jacket temperature;

$$(H) = \frac{1}{(KL)\sqrt{(PD)}}$$

(PD)=Pressure in variable volume chamber, 3, when fluid composition is being injected thereinto, pounds force per square foot;

$$(KL) = \sqrt{\frac{2(G)}{(DF)}\frac{(AD)}{(DF)}\left[\frac{(AD)}{(AP)}-1\right]\frac{(DF)}{(AD)}}$$

(G)=Gravitational Constant, English units;

(AD)=Air driver piston area, square feet;

(AP)=Air displacer piston area, square feet;

A preliminary design estimate can be made for the crank angle duration of fluid composition injection (CAJ), based on intended duration of burning time interval, for the particular engine usage. The above approximate relation assumes fluid composition injection to occur at or near engine piston top dead center, during the transition from the compression time interval to the expansion time interval.

The shape of the igniter jet nozzle can be adapted to fit the shape of the engine combustion chamber, relative to the position of the jet nozzle. For example, for a pancake combustion chamber, with the jet igniter positioned at an edge, as shown schematically in FIG. 3, an elliptical jet nozzle cross section could be used, with the minor axis of the ellipse parallel to the engine cylinder centerline.

Having thus described my invention, what I claim is:

1. In a piston internal combustion engine comprising: at least one combined means for compressing and expanding gases, each said combined means comprising: an internal combustion engine mechanism comprising a variable volume chamber for compressing and expending gases, and drive means for driving said internal combustion engine mechanism and varying the volume of said chamber through repeated cycles:

each said variable volume cycle comprising a compression time interval, when said variable volume is sealed and decreasing, followed by an expansion time interval, when said variable volume is sealed and increasing, these two time intervals together being a compression and expansion time interval;

each said combined means for compressing and expanding further comprising; intake means for admitting reactant gases into said variable volume chamber prior to each said compression time interval, said intake means comprising an intake manifold, exhaust means for removing reacted gases from said variable volume chamber after each said expansion time interval;

each said variable volume cycle further comprising an exhaust time interval, when said variable volume is opened to said exhaust means, followed by an intake time interval when said variable volume is opened to said intake means, these two time intervals being an exhaust and intake time interval which follows after a preceding expansion time interval and precedes a next following compression time interval; said piston internal combustion engine further comprising a source of supply of reactant gas containing appreciable oxygen gas to each said intake means for admitting reactant gases into said variable volume chamber; said piston internal combustion engine further comprising a source of principal engine fuel and means for delivering said principal engine fuel into said variable volume chamber;

each cycle of said variable volume chamber further comprising a potential combustion time interval comprising that portion of said compression and expansion time interval during which principal engine fuel and reactant gas containing appreciable oxygen gas are both present within said variable volume chamber; each cycle of said variable volume chamber further comprising a burning time interval during which the mixture of principal engine fuel and reactant gas containing appreciable oxygen gas is ignited and burned;

wherein the improvement comprises adding to said piston internal combustion engine at least one bubble jet igniter to each said variable volume chamber of said piston internal combustion engine, each said bubble jet igniter comprising:

at least one source of gas vent pressure;

air displacer means for compressing and displacing air and comprising: an air displacer piston sealably operative within an air displacer cylinder and said air displacer piston and cylinder enclosing an air displacer volume; an air driver piston sealably operative within an air driver cylinder and said driver piston and cylinder enclosing an air driver volume;

said air driver piston side opposite said air driver volume side being mechanically connected to said air displacer piston side opposite said air displacer volume side, and the volume thusly enclosed between said driver piston and said displacer piston being vented to one of said gas vent pressure sources whose pressure is no greater than atmospheric, said air driver piston area being larger than said air displacer piston area;

fuel displacer means for compressing and displacing fuel and comprising: a fuel displacer piston sealably operative within a fuel displacer cylinder and said fuel displacer piston and cylinder enclosing a fuel displacer volume; a fuel driver piston sealably operative within a fuel driver cylinder and said driver piston and cylinder enclosing a fuel driver volume;

said fuel driver piston side opposite said fuel driver volume side being mechanically connected to said fuel displacer piston side opposite said fuel displacer volume side, and the volume thusly enclosed between said driver piston and said displacer piston being vented to one of said gas vent pressure sources whose pressure is no greater than atmospheric, said fuel driver piston area being larger than said fuel displacer piston area;

the ratio of said fuel driver piston area, on the driver volume side, to said fuel displacer piston area, on the fuel displacer volume side, being equal to the ratio of said air driver piston area, on the driver volume side, to said air displacer piston area, on the air displacer volume side;

a source of igniter fuel at a pressure greater than atmospheric;

a bubbleizer enclosed chamber means for creating a fluid composition of air bubbles in fuel, and comprising a fuel inlet, an air inlet, and a fluid composition outlet;

an enrichener enclosed chamber means for increasing the fuel vapor content of said air bubbles within said fluid composition, and comprising a fluid inlet and a fluid outlet;

an igniter jet nozzle comprising a nozzle inlet and a nozzle outlet;

a two-way driver valve with actuator, and comprising; a single common connection to said fuel driver space and said air driver space and said common connection being always open; a driver gas connection to said variable volume chamber; a vent connection to one of said gas vent pressure sources; said two-way driver valve connections being always open to either said variable volume chamber or said gas vent pressure source, but not to both concurrently;

an on or off fuel supply valve with actuator, and comprising; an inlet connection from said source of igniter fuel; an outlet connection to said fuel displacer volume;

an on or off air supply valve with actuator, and comprising; an inlet connection form said variable volume chamber; an outlet connection to said air displacer volume;

an on or off fuel delivery valve, with actuator, and comprising; an inlet connection from said fuel displacer volume; an outlet connection to said fuel inlet of said bubbleizer chamber means;

an on or off air delivery valve, with actuator, and comprising; an inlet connection from said air displacer volume; an outlet connection to said air inlet of said bubbleizer chamber means;

said bubbleizer chamber fluid composition outlet connecting to said enrichener chamber fluid inlet, and this connection is always open;

said enrichener chamber fluid composition outlet connecting to said igniter jet nozzle inlet, and this connection is always open;

said igniter jet nozzle outlet connecting into said variable volume chamber, and this connection is always open;

an engine crank angle and variable volume cycle timing sensor;

control means for controlling the two way driver valve, and the opening and closing of the fuel and air supply valves, and the fuel and air delivery valves, and responsive to said engine crank angle and cycle timing sensor, and operative upon the actuators of said several valves, so that:

said two-way driver valve is open to said vent connection during at least a portion of said exhaust and intake time interval and a portion of said compression time interval;

said fuel supply valve is open during at least a portion of said exhaust and intake time interval when said two-way driver valve is open to said vent connection;

said air supply valve is open during at least that same portion of said compression time interval when said two-way driver valve is open to said vent connection;

said two-way driver valve is open to said variable volume chamber, commencing at the start of said burning time interval during the latter portion of the compression time interval, and ending after the end of said expansion time interval when said two-way driver valve is opened to said vent connection;

said fuel supply valve, and said air supply valve, are closed whenever said two-way driver valve is open to said variable volume chamber;

said fuel delivery valve is open to said bubbleizer chamber, commencing at the start of said burning time interval during the latter portion of said compression time interval, and ending no later than when said two-way driver valve is opened to said vent connection, and said fuel delivery valve is closed at other times of the variable volume cycle;

said air delivery valve is open to said bubbleizer chamber during at least a portion of the time when said two-way driver valve is open to said variable volume chamber, and is closed at other times of the variable volume cycle.

2. In a piston internal combustion engine as described in claim 1:

wherein said control means further controls the opening and closing of said fuel delivery valve and said air delivery valve, so that:

said fuel delivery valve is closed from said bubbleizer chamber prior to the ending of said expansion time interval;

said air delivery valve is closed from said bubbleizer chamber later than the time when said fuel delivery valve is closed from said bubbleizer chamber.

3. In a piston internal combustion engine as described in claim 1:

wherein said control means further controls the opening and closing of said fuel delivery valve and said air delivery valve, so that:

said air delivery valve is opened to said bubbleizer chamber somewhat later than the opening of said fuel delivery valve to said bubbleizer chamber.

4. In a piston internal combustion engine as described in claim 2: wherein said control means further controls the opening and closing of said fuel delivery valve and said air delivery valve, so that:

said air delivery valve is opened to said bubbleizer chamber somewhat later than the opening of said fuel delivery valve to said bubbleizer chamber.

5. In a piston internal combustion engine as described in claim 1:

wherein said control means is further operative upon said air delivery valve so that:

said air delivery valve is open to said bubbleizer chamber during at least two separate time portions of the time when said fuel delivery valve is open to said bubbleizer chamber, and is closed from said bubbleizer chamber between said separate time portions.

6. In a piston internal combustion engine as described in claim 5: wherein said control means further controls the opening and closing of said fuel delivery valve and said air delivery valve, so that:

said fuel delivery valve is closed from said bubbleizer chamber prior to the ending of said expansion time interval;

said air delivery valve is closed from said bubbleizer chamber later than the time when said fuel delivery valve is closed from said bubbleizer chamber;

said air delivery valve is opened to said bubbleizer chamber somewhat later than the opening of said fuel delivery valve to said bubbleizer chamber;

said air delivery valve is open to said bubbleizer chamber during at least two separate time portions of the time when said fuel delivery valve is open to said bubbleizer chamber, and is closed from said bubbleizer chamber between said separate time portions.

7. In a piston internal combustion engine as described in claim 1:

wherein at least one of said vent sources is the engine air intake manifold, and said vent connection of said two-way driver valve is connected to this vent source.

8. In a piston internal combustion engine as described in claim 1:

and further comprising:

an engine torque regulator;

fuel quantity control means for controlling the fuel quantity placed into said fuel displacer volume per variable volume cycle, and responsive to said engine torque regulator, so that; said fuel quantity per engine cycle increases as required engine torque increases.

9. In a piston internal combustion engine as described in claim 1: and further comprising:

spark ignition means for igniting air fuel vapor mixtures entering said variable volume chamber from said igniter jet nozzle outlet, and operative at least whenever said fuel delivery valve is open to said bubbleizer chamber.

10. In a piston internal combustion engine as described in claim 1:

and further comprising an engine speed sensor;

wherein said control means is additionally responsive to said engine speed sensor, and is also additionally operative upon said air delivery valve, so that: said air delivery valve is open to said bubbleizer chamber during a number of separate time portions of the time when said fuel delivery valve is open to said bubbleizer chamber, and is closed from said bubbleizer chamber between said separate time portions, and so that the sum of the durations of all said number of separate time portions, for each variable volume cycle is increased as engine speed is decreased.

11. In a piston internal combustion engine as described in claim 6:

wherein at least one of said vent sources is the engine air intake manifold, and said vent connection of said two-way driver valve is connected to this vent source;

and further comprising:

spark ignition means for igniting air fuel vapor mixtures entering said variable volume chamber from said igniter jet nozzle outlet, and operative at least whenever said fuel delivery valve is open to said bubbleizer chamber.

* * * * *